US006257440B1

(12) United States Patent
Perkins et al.

(10) Patent No.: US 6,257,440 B1
(45) Date of Patent: Jul. 10, 2001

(54) CONTAINER HANDLE AND RELATED METHODS

(75) Inventors: Ralph G. Perkins, Covina; Frano Luburic; Josef E. Bingisser, both of Costa Mesa; Norris McLean, Anaheim Hills, all of CA (US)

(73) Assignee: Ropak Corporation, Fullerton, CA (US)

( * ) Notice: Subject to any disclaimer, the term of this patent is extended or adjusted under 35 U.S.C. 154(b) by 0 days.

(21) Appl. No.: 09/288,590

(22) Filed: Apr. 8, 1999

(51) Int. Cl.[7] ..... B65D 25/00
(52) U.S. Cl. ..... 220/764; 220/755; 220/760
(58) Field of Search ..... 220/764, 754, 220/755, 759, 760, 769

(56) References Cited

U.S. PATENT DOCUMENTS

| | | | | |
|---|---|---|---|---|
| 308,343 | | 11/1884 | Cary . | |
| 472,130 | | 4/1892 | Lusk . | |
| 1,678,005 | | 7/1928 | Hallerman . | |
| 2,101,869 | | 12/1937 | Noble | 121/36 |
| 2,176,711 | | 10/1939 | Gorman, Jr. | 220/91 |
| 2,255,633 | | 9/1941 | Wagner . | |
| 2,654,115 | * | 10/1953 | Kafer | 220/755 X |
| 3,128,905 | | 4/1964 | Hesslein | 220/95 |
| 3,189,069 | | 6/1965 | Stowell | 145/61 |
| 3,275,366 | * | 9/1966 | Hidding | 220/760 X |
| 3,586,200 | * | 6/1971 | Kramer et al. | 220/755 |
| 3,656,594 | | 4/1972 | Marks et al. . | |
| 4,071,939 | | 2/1978 | Bock | 29/434 |
| 4,177,542 | | 12/1979 | Denney | 24/115 |
| 4,240,554 | | 12/1980 | Bock | 206/519 |
| 4,841,596 | | 6/1989 | Fink | 16/114 |
| 5,060,998 | | 10/1991 | Phillips | 294/146 |
| 5,145,082 | | 9/1992 | Craft, Jr. et al. | 220/755 |
| 5,199,571 | * | 4/1993 | Wolff et al. | 220/773 X |
| 5,344,041 | | 9/1994 | Luburic et al. | 220/760 |
| 5,402,910 | | 4/1995 | Pilney . | |
| 5,437,369 | | 8/1995 | Spitere | 206/373 |
| 5,816,439 | * | 10/1998 | Lovell et al. | 220/776 X |

FOREIGN PATENT DOCUMENTS

| | | | |
|---|---|---|---|
| 722573 | 1/1955 | (GB) | 220/776 |
| 2145993 | 4/1985 | (GB) . | |
| 2168238 | 6/1986 | (GB) | 220/776 |
| 2244972 | 12/1991 | (GB) | 220/770 |

* cited by examiner

*Primary Examiner*—Steven Pollard
(74) *Attorney, Agent, or Firm*—J. Mark Holland & Associates

(57) ABSTRACT

A handle useful in combination with a container includes a plastic strap or bail and a plastic sleeve thereon. The bail or strap of the handle is pivotably connected to the container, and the sleeve can be rotated about the bail. Structures are provided to distribute load forces between the bail and sleeve. Structures are also provided to retain the sleeve along the longitudinal axis of the bail. One or more clip members can be provided on the bail to engage the container. The clip member includes positioning elements to locate and engage the handle in a selected position with respect to the container. Preferred methods for assembling and using the apparatus (including the combination of the handle and container) are disclosed.

19 Claims, 3 Drawing Sheets

CONTAINER HANDLE AND RELATED METHODS

This invention generally relates to handles for containers, and specifically to an improved apparatus and methods of assembly and use for such devices, which provide comfort, security, economy, and ease of operation to the user.

BACKGROUND OF THE INVENTION

Frequently, people use containers to store, protect, manipulate, and transport various items, such as paint, water, sand, or any of a wide variety of other things and materials. To make these containers easier to use, handles are commonly provided, typically pivotably attached to the upper portion of opposed sidewalls of the container. These handles provide a relatively easy means for carrying the container as well as an easy method for pivoting the handle away from the opening of the container, to permit (for example) stacking of the container or access to the interior of the container. Such handles typically can pivot through a wide arc, from "upright" (e.g., above the container) to "down" against either side of the container. These handles also permit users to more readily hold and pivot the container to empty the contents from the container, or to scoop water, sand, or similar materials into the container.

Despite these positive attributes, current handles still lack several characteristics that provide increased comfort, economy, security, and ease of use to the user. One early example of such a handle is a metal bail "secured" to holes on the side of a bucket by bending the ends of the bail through and around those holes (for example, see U.S. Pat. No. 308,343). Not only are such metal handles relatively difficult to assemble onto containers (metal that is sufficiently stiff to carry loads in the bucket are correspondingly difficult to bend into engagement with the holes), but the combination of such a metal handle on a plastic container or bucket can complicate recycling efforts as the container is being discarded after use. In addition, metal handles remain at least somewhat susceptible to damage from corrosion, although the risk of such damage can be reduced by selecting a normally more expensive metal.

Plastic bails overcome some of the shortcomings of metal bails, but typically include their own limitations. Among other things, they typically consist only of the bail element; the inventors are not aware of rotatable handgrips ever being provided on plastic handles. This limits their usefulness or at least their comfort during use, especially where repeated lifting and transporting of containers is required (e.g. without a rotatable handgrip, the handle can pinch and bind the user's hand when attempting to carry, fill, or empty a container). Moreover, these plastic bails are typically extremely flexible and thus they may not be useful for carrying heavy loads or large containers (that flexibility focuses the heavy loads too greatly on the center portion of the user's hand). Furthermore, even plastic bails that might be reinforced with stiffening elements (so as to not be too "flimsy") still do not provide a separate or rotatable handgrip.

OBJECTS AND ADVANTAGES OF THE INVENTION

It is, therefore, an object of the invention to provide an improved apparatus and related methods that provide a comfortable and convenient handle and gripping portion for a user to carry, transport, and otherwise manipulate containers. The preferred embodiment of the invention constitutes an improved handle for a container in which the handle includes a plastic bail and a plastic sleeve to provide a comfortable gripping surface for manipulating the container.

It is a further object of the invention to provide a handle of the aforementioned character in which the bail or strap includes a plurality of structures to transmit and/or distribute load forces between the bail and the sleeve.

It is still a further object of the invention to provide a handle of the aforementioned character in which the bail is pivotable with respect to the container, and the sleeve is rotatable about the bail, further including corresponding engagement structures on the bail and sleeve to retain the sleeve at a selected position along the lengthwise axis of the bail.

It is yet a further object of the invention to provide a handle of the aforementioned character in which the bail has a first end and a second end, and the bail includes a clip member adjacent at least one of the ends to engage with the container. The preferred clip member is configured with positioning means thereon for locating and engaging the handle in a selected position with respect to the container.

It is another object of the invention to provide a strap member for carrying and transporting a container in which the strap member includes at least one load-distributing structure for distributing load forces between the strap member and a surrounding generally cylindrical sleeve member.

It is still another object of the invention to provide a strap member of the aforementioned character wherein at least one of the load-distributing structures engages with one or more beads located on an inner surface of the sleeve member.

It is yet a further object of the invention to provide a strap member of the aforementioned character in which the strap member includes clip means having an elliptically shaped stem with at least one rib element on the stem to provide selectable positioning of the strap member when the strap member is engaged with a container.

It is another object of the invention to provide a sleeve member for a container handle wherein the sleeve member is retained along the length of a strap member by detent means located on the inner surface of the sleeve member.

It is a further object of the invention to provide a sleeve member of the aforementioned character wherein the retained sleeve member is rotatable about the strap member.

It is still another object of the invention to provide a clip element on an elongated container handle strap member wherein the clip element includes a wide portion and a narrow portion situated between the wide portion and the strap member, wherein the narrow portion includes at least one rib element thereon to provide selectable temporary positioning of the handle with respect to a container on which it is engaged.

It is yet a further object of the invention to provide a clip element of the aforementioned character in which the wide portion is configured to permit a rotatable sleeve to slide thereover for assembly on the container handle at a position spaced from the clip element. Depending on the respective sizes of the sleeve and the handle's clip portion, one or the other may need to be shaped or configured to prevent interference between the two as the sleeve is slid over the clip.

It is still another object of the invention to provide an opening in a container to permit engagement of a handle therewith, in which the opening includes at least one groove to engage a corresponding rib on the handle.

It is yet another object of the invention to provide a selectably positionable handle and container assembly, including positioning means such as corresponding mateable elements on each of the container and the handle, in which the container and the handle are formed from plastic and the corresponding mateable elements permit the handle to be positioned and retained with respect to the container in at least one selected position.

It is yet a further object of the invention to provide the handle and container assembly of the aforementioned character in which the container includes at least one slot formed thereon for receiving a clip element formed on the handle, in which the mateable elements indude at least one interengageable groove and corresponding rib.

It is still another object of the invention to provide a method for assembling a plastic handle for use on a container including the steps of: a) sliding a plastic sleeve member over an elongated plastic strip member; and b) engaging one or more positioning beads on the inner surface of the sleeve member with corresponding engagement sites on the strap member.

It is yet a further object of the invention to provide a method of connecting a handle to a container including the steps of: a) providing an elongated strap having a clip member with a stem portion thereof having an elliptically-shaped cross-section; b) positioning the stem portion adjacent a slot formed on the container so that a shorter axis of the elliptically-shaped cross-section is generally perpendicular to a longitudinal axis of the slot; c) sliding the stem portion through a narrow portion of the slot along that longitudinal axis of the slot while the axes are generally perpendicular to each other, into a wider portion of the slot; and d) rotating the stem portion so that the shorter axis of the elliptically-shaped cross-section is out of the generally perpendicular alignment with respect to the longitudinal axis of the slot.

It is a further object of the invention to provide a method of the aforementioned character, further including the steps of providing at least a pair of cooperating engaging members on the stem portion and the wider portion of the slot, and temporarily affixing the handle against rotation about the stem by engaging the cooperating engaging members.

It is yet a further object of the invention to provide a method of the aforementioned character, further including the steps of temporarily retaining the handle away from the container to permit various operations or handling relating to the container assembly, such as filling of, or printing on, the container.

It is still a further object of the invention to provide a method of the aforementioned character, further including the step of assembling a cylindrical sleeve member on the elongated strap; and engaging the cylindrical sleeve member with the strap along the length thereof by engaging a positioning bead on the inner surface of the sleeve member with an engagement site on the strap.

It is still another object of the invention to provide a method of the aforementioned character wherein the steps are automated. Similar to other automated processes, including automation of container and strap fabrication and assembly, the benefits of the present product and method can be more fully realized or can be realized in different ways by automating same.

It is yet another object of the invention to provide a bucket and handle combination including: a) a bail ear on the bucket; b) a clip element formed on the handle for engagement with the bail ear; and c) cooperating engagement means acting between the bail ear and the clip element whereby the handle can rotate through a range of movements with respect to the bucket and can be temporarily positioned into at least one selected position with respect to the bucket.

It is a further object of the invention to provide a bucket and handle combination of the aforementioned character in which the cooperating engagement means includes at least one locating groove in the bail ear opening and at least one rib or detent formed in a cooperating location on the clip element.

Other objects and advantages of the invention will be apparent from the following specification and the accompanying drawings, which are for the purpose of illustration only.

DESCRIPTION OF PREFERRED EMBODIMENT

Figure 1:
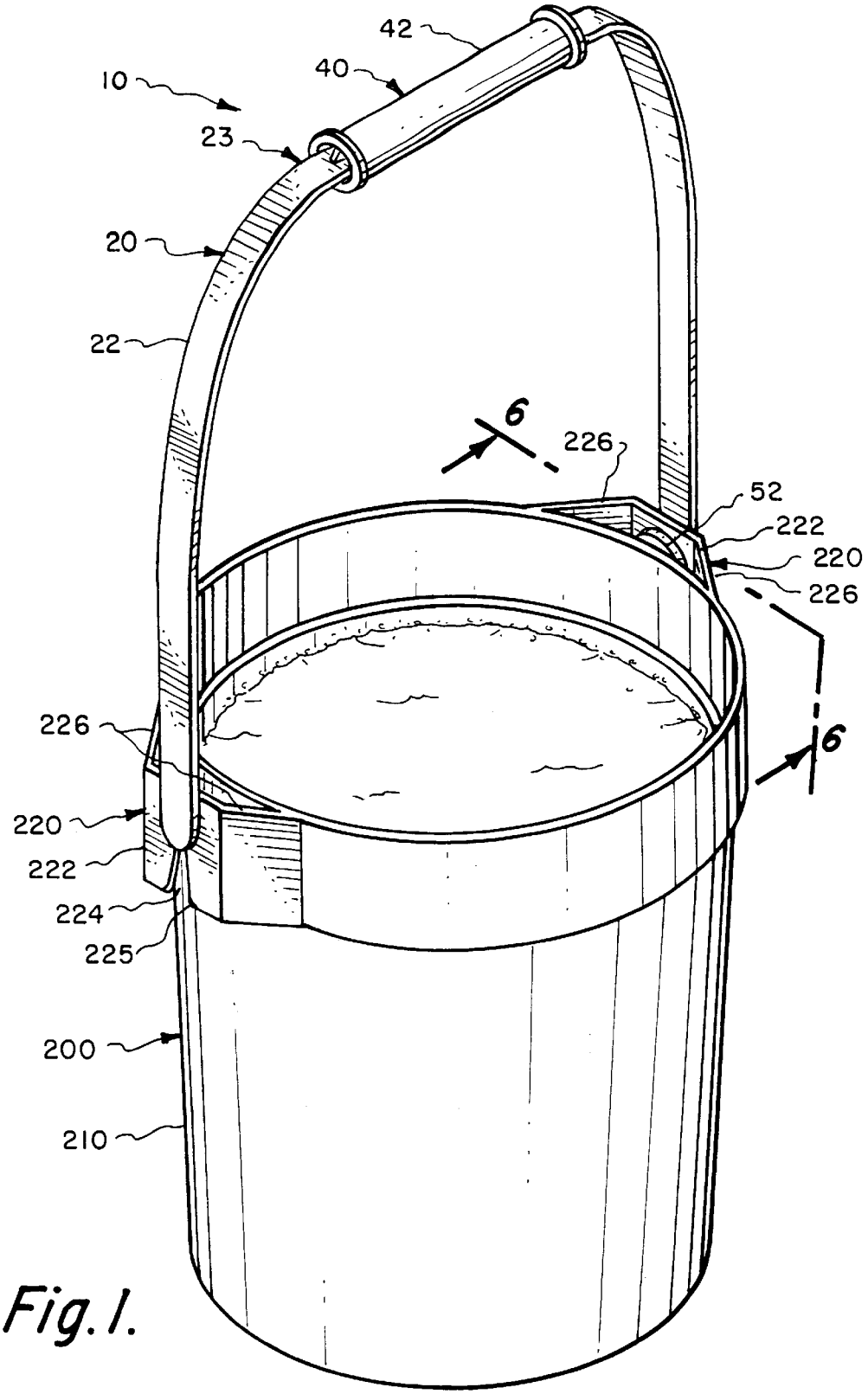
FIG. 1 is an isometric view of the preferred embodiment of the invention illustrating an assembled handle and container.

Referring to the drawings, and particularly to FIG. 1 thereof, we show a preferred embodiment of a handle and container combination 10 assembled in accordance with the teachings of the invention. The handle and container combination 10 preferably includes handle 20 and container 200. Handle 20 preferably includes a strap or bail 22 and a gripping means 40, such as sleeve member 42, positioned thereon. Container 200 preferably constitutes a bucket 210, but as will be apparent to one of ordinary skill in the art, container 200 can embody a wide variety of objects to which the handle might beneficially be attached. Examples include, without limitation, pails, boxes, etc., whether round, square, rectangular, oval, cubic or other configuration.

Handle 20 is preferably configured to have bail or strap member 22 pivotably mounted on bucket 210, with a portion of strap member 22 configured to cooperatively engage handgrip 40. Among other things, and as described herein, handgrip 40 preferably provides a convenient gripping surface for lifting or manipulating the assembly. Strap 22 and sleeve member 42 are preferably injection molded from plastic, but one of ordinary skill in the art will appreciate that either or both members may be manufactured with other suitable materials or methods. Desirable characteristics in these components include providing a flexible strap that can retain its shape, and a handgrip that provides increased comfort to the user. As described below, both strap 22 and sleeve 42 are preferably bi-directional (e.g. they can be assembled with respect to each other and with respect to the bucket in either direction), although unidirectional or other non-bidirectional embodiments can be provided and used.

The assembly of handle 20 and bucket 210 is preferably accomplished by engaging a clip member 50 (see FIG. 2) located near one of the ends of bail 22 with an opening such as a "bail ear" 228 (see FIGS. 8 and 9) on bucket 210. Preferably, opening 228 includes a channel portion 224 that tapers from a mouth area 225 to a preferably generally semicircular seating portion 229. In the preferred assembly, clip element 50 engages with opening 228 by sliding a relatively narrow stem portion 54 (see FIGS. 2 and 5) of clip means 50 through the mouth 225 of slot 224 to the seating portion 229 in hole 228.

Preferably, bucket or container 210 includes two openings (one each on opposing sidewalls of the bucket) to permit the attachment of the handle 20 to both sides of the bucket. However, as would be apparent to one of ordinary skill in the art, if one end of the handle is permanently affixed to one side of the bucket, it would only be necessary to provide one hole on the opposing sidewall. Among the many alternative embodiments of the invention, the preferred engagement could be provided on one end of the strap 22 and some other engagement mechanism on the other end.

In the preferred embodiment illustrated in FIGS. 1 and 6–9, opening 228 is formed in a bail ear or other clip-receiving element 220 that includes a wall member 222 generally parallel to the sidewall of container 200 and spaced radially outwardly therefrom. Wall member 222 is preferably secured to container 200 by supporting structures 226. Thus, preferred clip member 50 can readily engage with bucket 210 without having to provide an opening within the actual sidewall of the bucket itself, thereby retaining sealing and structural integrity within the bucket itself. In alternative embodiments, of course, the bail or strap could be attached to the bucket or other object in a variety of other configurations, such as by providing an opening similar to opening 228 directly in the wall of the bucket or object (not shown). Persons of ordinary skill in the art will understand that certain aspects of the invention can be practiced with any pivotable connection between the handle and container.

In the preferred embodiment, clip element 50 includes a relatively more narrow "stem" portion 54 and a wider head portion 52. It is sometimes convenient to refer to the narrow portion 54 of clip element 50 as a "stem" or a "neck", and the wide portion 52 of clip 50 as a "clip head". When preferably engaged on container 200, stem portion 54 acts as an axle rotatable within seating portion 229 of hole 228 in the side of bucket 210. Clip head portion 52 helps maintain the preferred rotatable engagement between handle 20 and bucket 210, by interferingly engaging with the parallel wall member 222 upon application of lifting force on handle 20.

Where necessary (given the factors and design considerations discussed herein), the side edges of clip head 52 can be "trimmed" (such as to form the relatively straight edges 62 and 63, FIGS. 2 and 6) or otherwise formed or configured in "non-round" shapes. Among other things, such non-round configurations may be necessary to facilitate the passage of the preferred sleeve 42 onto the strap 22, for embodiments in which such a sleeve is used, as discussed elsewhere herein. Depending on the relative sizes of the clip head 52 and the inner diameter of the sleeve 42, an "untrimmed" clip head 52 could prevent assembly of the sleeve onto the strap. Trimming or otherwise altering the sides of the clip head 52 can address the problem, while still maintaining good engagement between the strap and the bucket (see FIG. 6). For embodiments which generally align the trimmed edges 62 and 63 with a lengthwise axis of the handle 20, the "untrimmed" portions 60 of the clip head 52 extend further from the handle 20's axis of rotation and are normally aligned to effectively engage the wall member 222 and prevent the clip head 52 from being pulled out of engagement from the container 200 upon the application of lifting or similar force on the handle 20.

Figure 6:
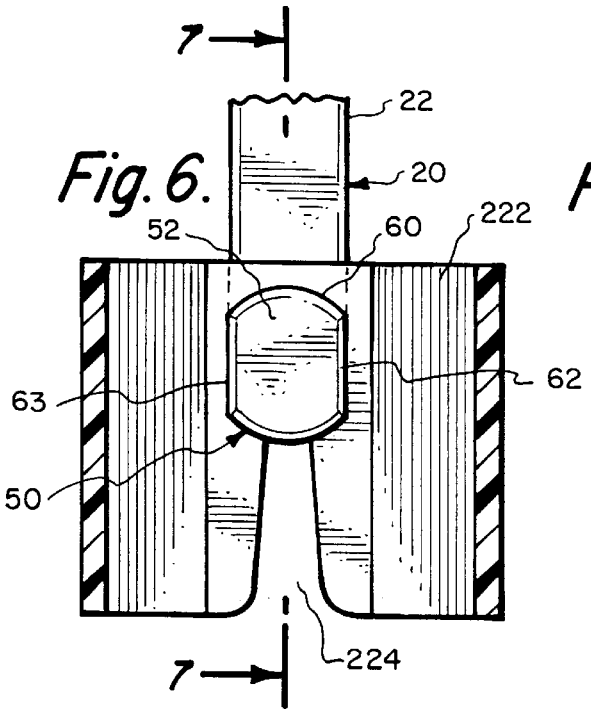
FIG. 6 is a cross-sectional view along reference line 6—6 of FIG. 1, illustrating the engagement of a clip element of a strap with a hole or slot on a bucket.
Figure 7:
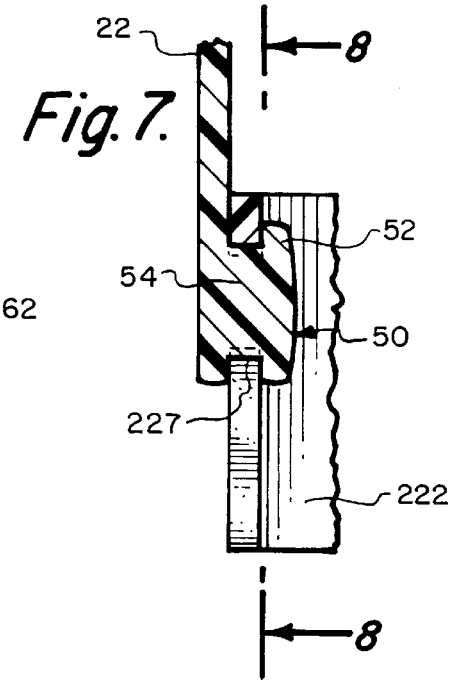
FIG. 7 is a cross-sectional view along reference line 7—7 of FIG. 6.

The preferred interrelationship of clip element 50 with hole 228 is more fully appreciated in FIGS. 6 and 7. FIG. 6 illustrates the placement of clip element 50 in hole 228 after being slid through slot 224. FIG. 7 shows the placement of clip head 52 of clip element 50 against the inner side of the wall member 222. In this preferred embodiment, the engagement of clip 50 with hole 228 secures clip 50 to bucket 210 by the positioning of clip head 52 around hole 228. As will be appreciated by persons of ordinary skill in the art, the entire underside or interior side of clip head 52 is preferably positioned to engage with wall member 222 (excepting at any gap, such as slot 224 in wall 222). The wider clip head thus prevents disengagement of the clip, and the handle, from the bucket.

Figure 8:
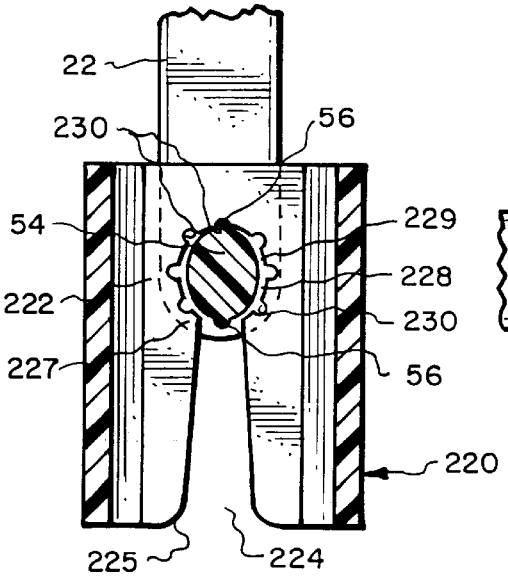
FIG. 8 is a cross-sectional view along reference line 8—8 of FIG. 7, depicting the cooperative engagement of a stem portion of a clip element with a hole or slot on a bucket.
Figure 9:
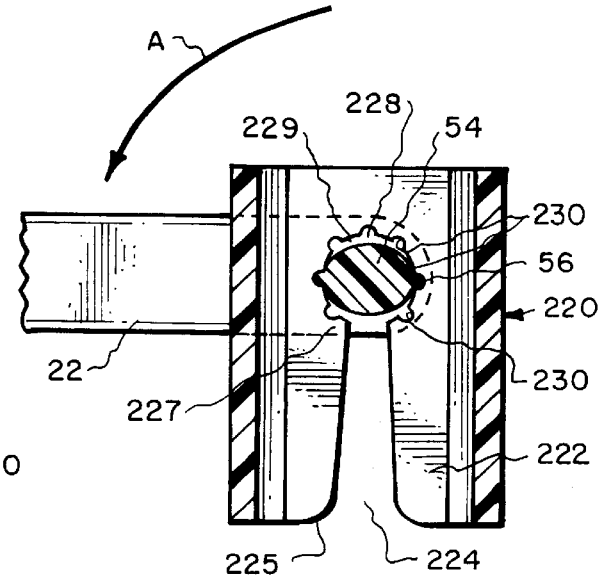
FIG. 9 is similar to FIG. 8 and illustrates the rotatable properties and engagement of a handle with a container.

As more easily seen in FIGS. 8 and 9, the "stem" or neck portion 54 is preferably generally elliptical in cross section. Among other things, this enables the strap to be inserted through mouth portion 225 of slot 224 (by aligning the narrow axis of the ellipse shape to make the stem "thin" so it can pass through the tapering slot) and thereafter pivotably retained in seating portion 229 of bail ear 228 on the side of the bucket (such as by, among other things, rotating the strap sideways to "misalign" the narrow ellipse axis and effectively "widen" the neck so it does not readily fall back down the slot 224). Following engagement of strap 22 on bucket 210, the "narrow" axis of the stem normally will only be "aligned" with slot 224 when bucket 210 is being carried. That very act of carrying will in most circumstances prevent the downward disengagement of the neck 54 out of slot 224 because the "carrying" will involve a lifting force on the handle 20 in the opposite direction. In effect, during those "carrying" periods, the lifting force exerted on the handle 20 will tend to keep the stem 54 from falling downwardly out of the slot 224. In other words, when bucket 210 is being carried, strap 22 will not normally "fall" out of engagement because, by definition, the user will be lifting the strap "up", and thereby pulling stems 54 of clip elements 50 of strap 22 away from slot 224. Furthermore, the narrow portion 54 of clip element 50 is shaped to provide greater strength to the clip element in the direction of load, whether the container is being carried, poured from, or otherwise experiencing a load on the handle.

Moreover, the preferred slot 224 tapers to a slightly narrower width at its narrowest location 227, FIGS. 7–9, so that sliding the neck 54 through location 227 is an interference fit. In other words, the edges of slot 224 forming that narrowest location 227 preferably elastically deform slightly to permit the passage of the neck 54 therethrough, and preferably spring back to their approximately original position to help retain neck 54 from falling out of seating portion 229. However, persons of ordinary skill in the art will realize that several factors, such as the materials and dimensions of the member defining the slot 224, affect the amount of force required to insert the neck 54, the memory (or "return") the edges have after the neck 54 is inserted, and the difficulty of disengaging the neck once engaged.

At many or most times other than during lifting, strap 22 will normally be rotated sideways in some degree (see FIG. 9, illustrating a 90 degree rotation) so that the "wider" stem axis of the elliptical neck 54 helps keep the strap 22 from disengaging from bucket 210.

Among other things, pouring from bucket 210 is more "secure" than with prior art circular necks because the widened elliptical neck is less likely to pull out of engagement. For example, and as illustrated in FIG. 9, typical pouring may involve holding the bottom of bucket 210 with one hand while holding handle 20 with the other. Such pouring (or scooping material into the bucket, as discussed elsewhere herein) may be facilitated by rotating the handle 22 about an axis of clip element 50 (in FIG. 9, the axis may be viewed as an imaginary line perpendicular to the page through the center of element 54), as indicated by arrow A in FIG. 9. As will be apparent to persons of ordinary skill in the art, the handle 22 preferably can be moved through a "normal" full range of movement (from upright to "down" against the side of the container 200).

Additionally, and as more fully described below, the handle can be temporarily "retained" or otherwise positioned at any number of degrees through arc A, by engaging positioning means such as mateable elements 56 and 230 positioned around stem 54 and around the perimeter of opening 228, respectively. Persons of ordinary skill in the art will understand that the precise number of such mateable elements 56 and 230 and their location may be affected by a range of factors, including the nature of the materials from which handle 22 and bucket 210 are molded, the application for which the assembly is intended, and others. Similarly, such persons will understand that the various dimensions and materials from which the apparatus is fabricated can affect the strength of the "engagement" between the handle and the container, and correspondingly the amount of effort required for a user to move the handle from one such position to another.

While this handle rotation occurs, a user can hold the rotating grip sleeve 40 and the bucket, and have little, if any, twisting or discomfort caused by the handle 22. Instead, the handle remains aligned with respect to its clip members engagement with the container 200 by simply rotating within the handgrip (which will typically be held from rotating by the user).

In addition to the comfort and usability afforded by rotating grip sleeve 40, the elliptical stem (see FIG. 9) in this "rotated" position preferably positions the widest elliptical dimension of neck 54 against slot 224, thereby reducing the risk of stem 54 pulling back through (out of) slot 224. Persons of ordinary skill in the art will understand that varying degrees of this benefit can be achieved at varying positions of the handle 22 through the arc A. In the preferred embodiment, the maximum benefit in this regard occurs when the handle 22 is positioned as shown in FIG. 9.

In contrast, prior art "circular neck" clips typically present a constant cross-section against the slot, regardless of the handle orientation. This cross-section is typically equal to the narrower of the two diameters of the elliptical stem as illustrated in the present application. In effect, and unlike the beneficial design of the invention, the prior art effective neck stem dimension that is small enough to permit the circular stem to be engaged with the container (roughly the same dimension as the preferred embodiment's "narrow" diameter) does not "increase" as the handle is rotated from the vertical.

In the preferred embodiment, positioning means such as one or more rib elements 56 are preferably provided on the sides of neck 54, and are sized, located, and shaped to permit selectable, frictional engagement with mating grooves 230 provided in hole 228 of bucket 210. Ribs 56, of neck 54 can retainingly engage with grooves 230 to temporarily position handle 20 at a desired rotated position with respect to bucket 210. Preferably, rib or ribs 56 and grooves 230 are formed from a sufficiently deformable, resilient material to permit the movement of ribs 56 into and out of engagement from groove or grooves 230 with the application of some reasonable amount of force by a user.

As indicated above, the preferred elliptical shape of neck 54 permits, among other things, the insertion of clip element 50 into hole 228 and the subsequent engagement of ribs 56 with grooves 230. Preferably, rib or ribs 56 are positioned on neck 54 at locations off of the "narrow" elliptical axis so as to, among other things, not interfere with snapping neck 54 through the narrowest location 227 of slot 224. In other words, ribs 56 on stem 54 are preferably located on opposite sides of the longitudinal axis of the elliptical stem 54 (as best shown in FIG. 8). However, in alternative embodiments, any number of ribs or grooves can be provided at any convenient position (such as out of alignment with each other or with the axis of the stem 54) to provide a desired range of movement and securement.

In addition, and as will be apparent to persons of ordinary skill in the art, alternative embodiments can even possess no ribs and yet still maintain certain beneficial aspects of the invention. For example, the elliptical shape of stem 54 can still provide increased strength across the longitudinal axis of the elliptical cross-section of the stem and resistance to disengagement at various handle positions, as compared to prior art stems having a circular cross-section.

As described below, ribs 56 and grooves 230 constitute mateable elements to permit, among other things, a user to position and temporarily "retain" the strap in various selected positions with respect to bucket 210. Among the many useful applications of this aspect of the invention is the ability to position the strap out of the way when filling, or printing on, the bucket, without the use of external machinery or equipment. In other words, the preferred bucket and strap assembly incorporates within its own structure the ability to desirably position and temporarily retain the strap at a selected location (rather than simply hanging down against the side of the bucket, in the way of imprinting or other actions). As persons of ordinary skill in the art will further appreciate, the frictional engagement of ribs 56 and grooves 230 preferably permits, among other things, an end user to position and keep the handle in a vertical or nearly vertical position when the container is not being carried or used. Among other things, this provides an additional ergonomic benefit to the end user by eliminating or reducing the amount of bend the user must employ in order to grasp the handle. For example, if the container and handle assembly is left with the handle so engaged vertically, a person can pick up or otherwise manipulate the container via the handle, without having to stoop as far down to reach the bail as would be required with conventional handle arrangements.

In contrast to this ergonomic improvement, conventional handles typically fall and rest on the side of the container. Thus, the end user of these prior art containers must bend over much further to grasp and lift the handle and container. Among other things, this increases the risk of physical injury to the end user as well as results in an increase in the expenditure of time and effort to grasp the handle. The speed at which various processes are executed (such as assembly line processes) can thereby be increased. Persons of ordinary skill in the art will understand that similar benefits can result from the aforementioned engagement of the preferred handle and container, for positions other than vertical.

Similarly, prior art containers and handles typically require the use of additional machinery to temporarily move and retain handles away from the container to permit printing thereon. The preferred embodiment of the instant invention eliminates the need for manufacturers, suppliers, or other users to invest in the additional cost and space for such machinery, by providing means within the handle and bucket assembly itself to temporarily retain the strap at a selected position (such as during imprinting on the outside of the bucket).

Figures 2, 3, 4, 5:
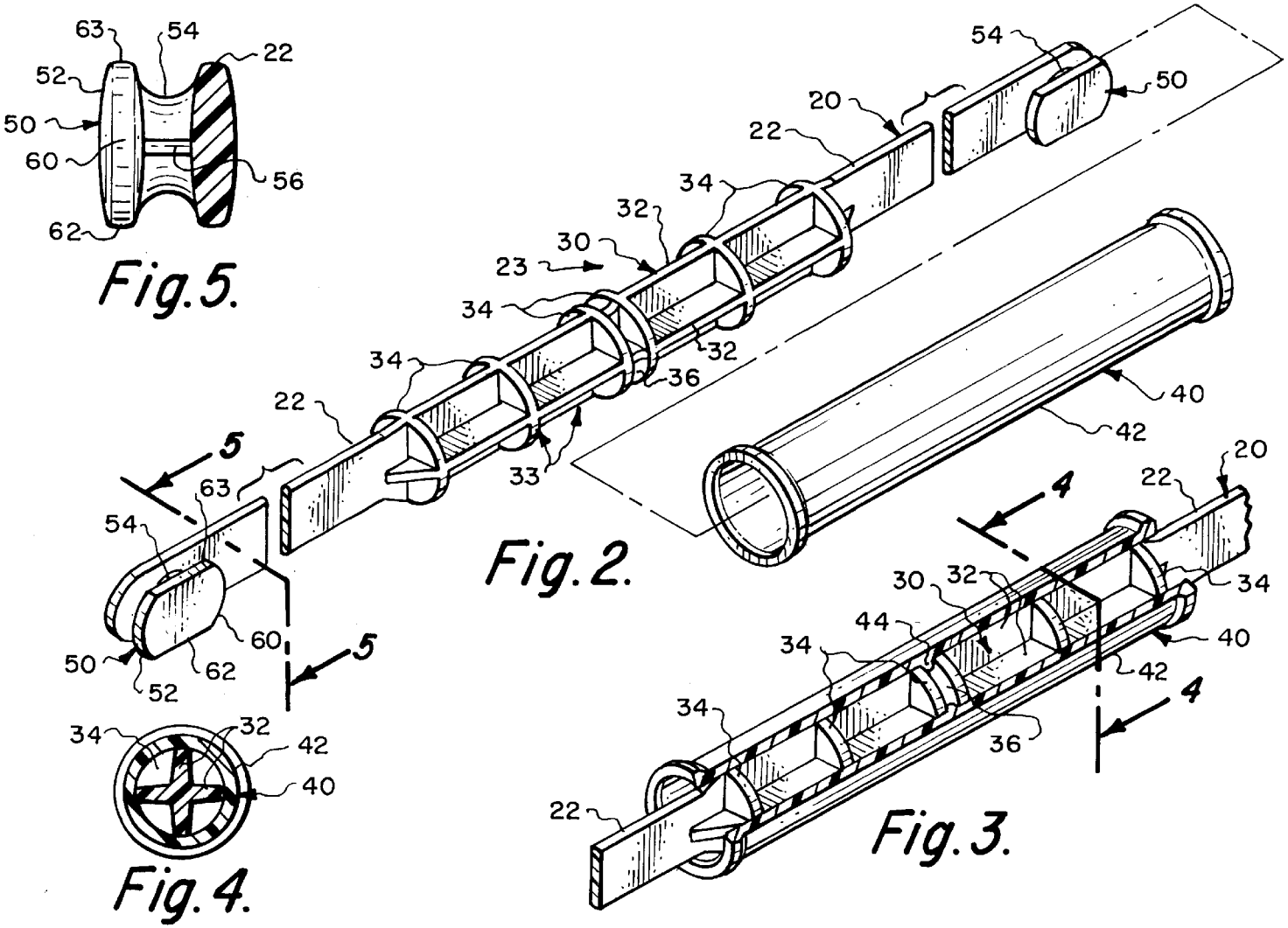
FIG. 2 is an exploded isometric view of preferred embodiments of the strap member (illustrating a centrally located engagement site), each end of the strap member, and the sleeve member.
FIG. 3 is a partial sectional view of the preferred assembly of a strap member and a sleeve member of the invention.
FIG. 4 is a cross-sectional view along reference line 4—4 in FIG. 3.
FIG. 5 is a cross-sectional view of the preferred embodiment of a clip element along reference line 5—5 of FIG. 2.

FIGS. 2–4 provide further details regarding a preferred embodiment of the central portion 23 of strap member 22. Among other things, preferred central portion 23 includes one or more engagement sites 30 for positioning sleeve 42 along the length of strap 22. For many or most applications, it will be desirable to have sleeve 42 at least generally centered between the ends of strap 22. Persons of ordinary skill in the art will understand, however, that various aspects of the invention can be practiced with the sleeve 42 positioned other than at the center of strap 22.

Moreover, various aspects of the invention can be practiced without any "positioning"at all of sleeve 42 along the length of strap 22. Such positioning can, however, retain the sleeve 42 at a generally optimal location for lifting or other manipulation of the container assembly, as discussed herein.

The desired positioning of sleeve 42 in that regard is preferably accomplished by providing an engagement site 30 along the length of the strap, including one or more recessed channels 36, which can be conveniently bounded by two circular discs 34 formed on strap 22. As indicated below, engagement structures (such as elements 36 and 44) acting between the sleeve and the strap can be located at any number of engagement sites (or at multiple sites) along the length of sleeve 42 or strap 22 (respectively), depending on the particular application and the user's needs. As indicated above, however, preferably such a channel 36 is provided at the center of engagement site 30 acting to engagingly receive internal annular bead 44 on the interior of sleeve 42 (as best illustrated in FIG. 3). Persons of ordinary skill in the art will understand that the internal annular bead 44 can be provided in many alternative embodiments (not shown), including, for example, one or more detents formed on the interior of sleeve 42.

The preferred configuration of channel 36 and bead 44 on sleeve 42 permits generally free rotation of sleeve 42 around strap 22. Among other things, this enhances comfort during use because there is no sliding friction or related pull on a user's hand. Instead, the gripping surface provided by sleeve 42 preferably rotates upon the application of transverse force, eliminating sliding between the user's hand and sleeve 42.

In the illustrated preferred embodiment, the central portion 23 of strap 22 further includes load-distributing structures 33 such as generally longitudinal elements 32 along the longitudinal axis of strap member 22 and one or more spaced circular discs 34 (preferably formed orthogonally to the longitudinal strap axis. The supporting structures 33 provide a number of benefits, including helping to distribute the bucket's weight across the sleeve 42 when lifting the bucket 210.

Persons of ordinary skill in the art will understand that a wide variety of suitable supporting structures and patterns 33 can be readily formed or provided on strap 22(in alternative embodiments not shown). Such alternative embodiments would preferably permit the desired assembly and rotation of the sleeve about the strap, as discussed herein.

As further shown in FIG. 4, the preferred embodiment includes four longitudinal elements 32 and six circular discs 34, but in alternative embodiments, any number of longitudinal elements or circular discs (or other supporting structures providing load-bearing contact between the sleeve 42 and strap 22) could be provided.

FIG. 2 also illustrates a preferred embodiment of rotatable sleeve member 42 prior to its assembly onto strap 22. Preferably, sleeve member 42 is cylindrical in shape, but as one of ordinary skill in the art can appreciate, the exterior gripping surface can embody a variety of shapes such as ovular, ribbed, or even more complex shapes to fit the contours of the users hand or fingers.

FIG. 3 shows further details regarding the preferred rotatable sleeve 42 and its preferred assembly onto strap 22. FIG. 3 is a partial-sectional view of the sleeve member 42 operatively engaged with strap 22. Sleeve 42 is preferably configured with detent means 44 centrally located on an interior surface of sleeve 42, with detent 44 defining a continuous annulus that circumscribes that interior (as indicated above, detent 44 can be provided in a wide variety of alternative embodiments, including without limitation a plurality of such interior annular rings 44 spaced from each other inside sleeve 42). The preferred sleeve's interior ring 44 engages the strap's complementary recessed channel or locator ring portion 36 described above. In alternative embodiments (not shown), multiple interior annular rings 44 might engage multiple corresponding recessed channels or locator ring portions 36.

Thus, among the many other embodiments of the invention are those utilizing a plurality of detents (rather than a single, monolithic ring) to provide the desired engagement between the sleeve 42 and the strap 22. By way of further example, although detent 44 preferably is a continuous ring-like structure, it can be sectioned (e.g. quarters or eighths or otherwise, even randomly) and still permit the engagement of the sleeve with recessed ring 36 of the engagement site.

Similarly, although the preferred location of the sleeve's detent 44 and strap channel or locator ring 36 is midway along the respective longitudinal axes of sleeve 42 and strap 22, (which, among other things, permits the bi-directional assembly of those parts with each other), alternatively the engagement structures (such as elements 36 and 44) can be located at any number of sites (or at multiple sites) along the length of sleeve 42 or strap 22 (respectively), depending on the particular application and the user's needs. As indicated above, in the preferred embodiment both the strap and sleeve are made of plastic, but they can be made of any suitable material.

Persons of ordinary skill in the art will understand that, for embodiments including both the attachment structures at the end of the strap 22 (to attach the strap to the container 200) and the inventive sleeve 42 of the invention, some coordination of various design elements may be required. For example, and as indicated above, FIGS. 2 and 5 illustrate the preferred embodiment of protruding clip element 50 at each end of strap 22. The particular size and shape of clip 50 will normally be selected and determined based on a number of factors. To provide a secure engagement with the bucket, clip 50 should be relatively large (e.g. the greater the anticiipated load on the strap, the larger the clip probably needs to be). Because sleeve 42 preferably slides over the end of strap 22 to be assembled onto the center of the strap, however, the relative size of clip 50, sleeve 42, and other elements of the strap (e.g. circular discs 34 and longitudinal ribs 32) must be coordinated to provide both adequate load capacity (to provide sufficient strength and engagement of the handle 20 with the container 200 so that the anticipated load on the strap does not pull the strap out of engagement from the bucket) and permit ready assembly of the sleeve 42 onto the strap 22. One of the many approaches that can be taken (and may be necessary) in that regard is the aforementioned "trimming" of the clip head 52. As indicated above, this can be readily accomplished by, among other things, forming flat surfaces 62 and 63 on opposing sides of the head 52.

The apparatus and methods of our invention have been described with some particularity, but the specific designs, constructions and steps disclosed are not to be taken as delimiting of the invention. Obvious modifications will make themselves apparent to those of ordinary skill in the art, all of which will not depart from the essence of the invention and all such changes and modifications are intended to be encompassed within the appended claims.

We claim:

1. A handle for a container, said handle including a plastic bail and a plastic sleeve member that includes at least one monolithic tube portion around at least a portion of said bail, said sleeve member providing a gripping surface for manipulating said container, in which said bail has a first end and a second end, and said bail includes a clip member adjacent at least one of said ends for engaging with the container, said clip member having an elliptical cross-section.

2. The handle of claim 1 wherein said bail includes a plurality of structures for transmitting load forces between said bail and said sleeve member.

3. The handle of claim 1 wherein said sleeve member is rotatably mounted on said bail, further including corresponding engagement structures on said bail and said sleeve member to retain said sleeve member at a selected position along a lengthwise axis of said bail.

4. The handle of claim 1 or claim 2 or claim 3 in which said clip member further includes positioning means thereon for locating and engaging said handle in a selected position with respect to the container.

5. The handle of claim 4 wherein said positioning means permits said handle to be positioned and kept in a substantially vertical position when the container is in its normal upright position and not being carried or used.

6. A strap member for transporting a container wherein said strap member includes an elongated section having at least one load-distributing structure thereon for distributing load forces between said strap member and a surrounding generally cylindrical sleeve member, and clip means formed on said strap member, said clip means having an elliptically shaped stem having at least one rib element thereon to provide selectable positioning of said strap member when said strap member is engaged with a container.

7. The strap member of claim 6 wherein at least one of said load-distributing structures engages with one or more beads located on an inner surface of said generally cylindrical sleeve member.

8. A clip element on an elongated container handle strap member wherein said clip element includes a wide portion and a narrow portion situated between said wide portion and said strap member, wherein said narrow portion includes at least one rib element thereon to provide selectable positioning of the handle with respect to a container on which it is engaged.

9. The clip element of claim 8, in which said wide portion is configured to permit a rotatable sleeve to slide thereover for assembly on the container handle at a position spaced from said clip element.

10. The clip element of claim 8 or claim 11 wherein said narrow portion is elliptical in cross section.

11. A clip element to engage a handle with a container, wherein said clip element includes a narrow portion and a wide portion, said narrow portion having a non-circular cross-section to provide greater strength to said clip element in the direction of load normally applied to the handle, wherein said narrow portion of said clip element is elliptical in cross section.

12. A method of connecting a handle to a container including the steps of:

a) providing an elongated strap having a clip member with a stem portion thereof having an elliptically-shaped cross-section;

b) positioning said stem portion adjacent a slot formed on said container so that a shorter axis of said elliptically-shaped cross-section is generally perpendicular to a longitudinal axis of said slot;

c) sliding said stem portion through a narrow portion of said slot while said axes are generally perpendicular to each other, into a wider portion of said slot; and d) rotating said stem portion so that said shorter axis of said elliptically-shaped cross-section is out of said generally perpendicular alignment with respect to said longitudinal axis of said slot.

13. The method of claim 12 further including the steps of providing at least a pair of cooperating engaging members on said stem portion and said wider portion of said slot, and temporarily affixing said handle against rotation about the stem by engaging said cooperating engaging members.

14. The method of claim 12 or claim 13, including the steps of assembling a cylindrical sleeve member on said elongated strap; and engaging said cylindrical sleeve member with said strap along the length thereof by engaging a positioning bead on the inner surface of said sleeve member with an engagement site on said strap.

15. The method of claim 13, further including the step of printing information on said container while said handle is so temporarily affixed.

16. The method of claim 12 or claim 13 wherein said steps are automated.

17. A strap member for transporting a container wherein said strap member includes at least one load-distributing structure for distributing load forces between said strap member and a surrounding generally cylindrical sleeve member; and clip means having an elliptically shaped stem having at least one rib element thereon to provide selectable positioning of said strap member when said strap member is engaged with a container.

18. The strap member of claim 17 wherein at least one of said load-distributing structures engages with one or more beads located on an inner surface of said generally cylindrical sleeve member.

19. The handle of claim 1 further including corresponding engagement structures acting between said bail and said sleeve in which said corresponding engagement structures include a bead structure and an annular groove, said bead structure configured to be positioned within said annular groove.

* * * * *

UNITED STATES PATENT AND TRADEMARK OFFICE

CERTIFICATE OF CORRECTION

PATENT NO. : 6,257,440 B1
DATED : July 10, 2001
INVENTOR(S) : Perkins et al.

It is certified that error appears in the above-identified patent and that said Letters Patent is hereby corrected as shown below:

Column 12,
Line 8, delete "11" and replace with -- 9 --, so line reads, "The clip element of claim 8 or claim 9 wherein said"

Signed and Sealed this

Eleventh Day of November, 2003

JAMES E. ROGAN
*Director of the United States Patent and Trademark Office*